US010457900B2

(12) United States Patent
Fossum et al.

(10) Patent No.: US 10,457,900 B2
(45) Date of Patent: Oct. 29, 2019

(54) DETERGENT COMPOSITION COMPRISING AN ALKYL ETHER SULFATE-RICH SURFACTANT SYSTEM AND COATED ENCAPSULATES

(71) Applicant: The Procter & Gamble Company, Cincinnati, OH (US)

(72) Inventors: Renae Dianna Fossum, Middletown, OH (US); Gregory Thomas Applegate, Cincinnati, OH (US); Anne Compton Rodrigue, Hyde Park, OH (US)

(73) Assignee: The Proctor & Gamble Company, Cincinnati, OH (US)

( * ) Notice: Subject to any disclaimer, the term of this patent is extended or adjusted under 35 U.S.C. 154(b) by 11 days.

(21) Appl. No.: 15/159,870

(22) Filed: May 20, 2016

(65) Prior Publication Data

US 2017/0335247 A1 Nov. 23, 2017

(51) Int. Cl.

| | |
|---|---|
| ***C11D 1/83*** | (2006.01) |
| ***C11D 3/50*** | (2006.01) |
| ***C11D 1/22*** | (2006.01) |
| ***C11D 1/29*** | (2006.01) |
| ***C11D 1/66*** | (2006.01) |
| ***C11D 1/75*** | (2006.01) |
| ***C11D 11/00*** | (2006.01) |
| ***C11D 1/02*** | (2006.01) |
| ***C11D 3/37*** | (2006.01) |
| ***C11D 17/00*** | (2006.01) |

(52) U.S. Cl.

CPC ..... *C11D 3/505* (2013.01); *C11D 1/02* (2013.01); *C11D 1/22* (2013.01); *C11D 1/29* (2013.01); *C11D 1/66* (2013.01); *C11D 1/75* (2013.01); *C11D 1/83* (2013.01); *C11D 3/3773* (2013.01); *C11D 11/0017* (2013.01); *C11D 17/0013* (2013.01)

(58) Field of Classification Search

CPC .... C11D 1/22; C11D 1/29; C11D 1/72; C11D 1/75; C11D 1/83; C11D 3/505; C11D 9/44

See application file for complete search history.

(56) References Cited

U.S. PATENT DOCUMENTS

| | | | | |
|---|---|---|---|---|
| 7,968,510 | B2 | 6/2011 | Smets et al. | |
| 8,202,831 | B2 * | 6/2012 | Lant | C11D 3/38636 435/200 |
| 8,236,745 | B2 * | 8/2012 | Panandiker | C11D 3/40 510/276 |
| 8,759,275 | B2 * | 6/2014 | Smets | A01N 25/28 134/42 |
| 2011/0237487 | A1 * | 9/2011 | Souter | C11D 3/38609 510/374 |
| 2011/0257062 | A1 * | 10/2011 | Dykstra | C11D 3/30 510/303 |
| 2012/0129751 | A1 * | 5/2012 | Miracle | C09B 31/072 510/295 |
| 2012/0208739 | A1 * | 8/2012 | Dykstra | C11D 3/2058 510/426 |
| 2014/0349913 | A1 * | 11/2014 | Delaney | C11D 1/002 510/488 |
| 2015/0057212 | A1 | 2/2015 | Hulskotter et al. | |
| 2015/0057213 | A1 * | 2/2015 | Hulskotter | C11D 3/3723 510/392 |
| 2015/0099680 | A1 | 4/2015 | Smets et al. | |
| 2015/0203798 | A1 * | 7/2015 | Miracle | C11D 3/42 510/295 |
| 2015/0275142 | A1 * | 10/2015 | Hulskotter | C11D 3/3723 510/320 |
| 2015/0376550 | A1 * | 12/2015 | Ohtani | C11D 3/505 510/296 |
| 2016/0040104 | A1 * | 2/2016 | Liu | C11D 17/0039 510/296 |
| 2016/0060570 | A1 | 3/2016 | Panandiker et al. | |
| 2016/0060571 | A1 | 3/2016 | Panandiker et al. | |
| 2016/0060572 | A1 | 3/2016 | Panandiker et al. | |
| 2016/0060573 | A1 | 3/2016 | Fossum et al. | |
| 2016/0060575 | A1 | 3/2016 | Panandiker et al. | |
| 2016/0090551 | A1 | 3/2016 | Fossum et al. | |
| 2016/0108340 | A1 * | 4/2016 | Feng | A61Q 15/00 512/4 |
| 2016/0122692 | A1 * | 5/2016 | Lant | C11D 3/38627 435/263 |
| 2016/0168516 | A1 * | 6/2016 | Liu | C11D 17/0013 510/337 |
| 2017/0022459 | A1 * | 1/2017 | Denutte | A61K 8/11 |
| 2017/0119917 | A1 * | 5/2017 | Frankenbach | A61L 9/01 |
| 2018/0134995 | A1 * | 5/2018 | Torres | C09B 69/00 |

FOREIGN PATENT DOCUMENTS

WO WO 2015/144053 A1 10/2015

OTHER PUBLICATIONS

PCT International Search Report for application No. PCT/US2017/033009, dated Jul. 25, 2017, 11 pages.
PCT International Search Report for application No. PCT/US2017/033010, dated Jul. 25, 2017, 12 pages.
PCT International Search Report for application No. PCT/US2017/031524, dated Jul. 27, 2017, 30 pages.
EP Search Report for application No. 11188595.0-1221, dated Jan. 17, 2012, 12 pages.
PCT International Search Report for application No. PCT/US2010/055393, dated Feb. 23, 2011, 5 pages.

(Continued)

*Primary Examiner* — Charles I Boyer

(74) *Attorney, Agent, or Firm* — Andres E. Velarde; Gregory S. Darley-Emerson

(57) ABSTRACT

Liquid detergent compositions having a surfactant system and encapsulates, where the surfactant system includes anionic alkoxylated alkyl sulphate surfactant. Methods of making and using such detergents.

17 Claims, 1 Drawing Sheet

(56) References Cited

OTHER PUBLICATIONS

PCT International Search Report for application No. PCT/US2015/1046627, dated Nov. 24, 2015, 11 pages.
PCT International Search Report for application No. PCT/US2015/046628, dated Nov. 26, 2015, 11 pages.
PCT International Search Report for application No. PCT/US2015/046629, dated Nov. 10, 2015, 11 pages.
U.S. Appl. No. 15/159,846, filed May 20, 2016, Gregory Thomas Applegate.
U.S. Appl. No. 15/590,077, filed May 9, 2017, Renae Dianna.

* cited by examiner

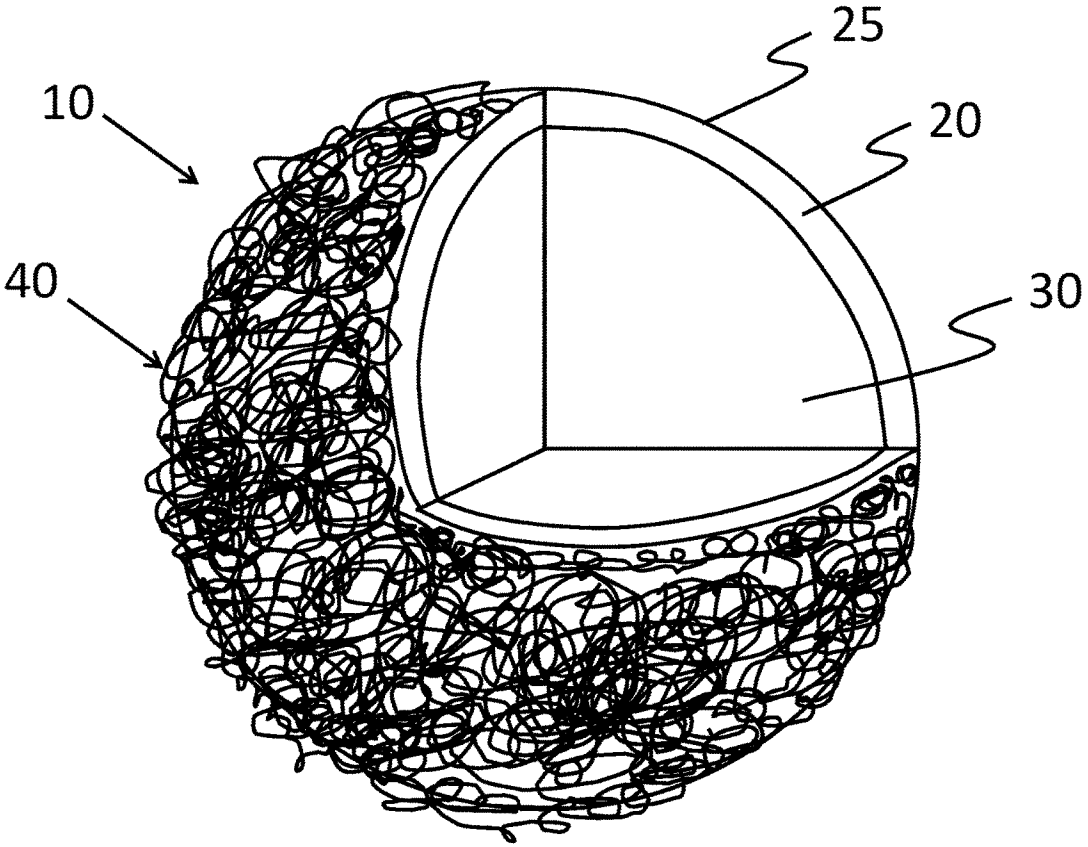
10
40
25
20
30

DETERGENT COMPOSITION COMPRISING AN ALKYL ETHER SULFATE-RICH SURFACTANT SYSTEM AND COATED ENCAPSULATES

FIELD OF THE INVENTION

The present disclosure relates to liquid detergent compositions having a surfactant system and encapsulates, where the surfactant system includes anionic alkoxylated alkyl sulphate surfactant. The present disclosure also relates to methods of making and using such detergents, for example to treat a fabric.

BACKGROUND OF THE INVENTION

Detergent compositions having surfactant systems that include multiple surfactants are known. Although such detergents may offer broad cleaning benefits, they can be complex and costly to manufacture.

A detergent composition having a simpler surfactant system may be preferable from a complexity or cost perspective, but the surfactant systems are typically less robust. Therefore, a manufacture may desire to provide other consumer-relevant benefit agents, such as perfume, to increase the attractiveness of his/her detergent.

Such benefits may be provided in encapsulated form to allow for extended release once deposited on a surface. However, when the encapsulates do not deposit efficiently, the loss of the encapsulates (and the benefit agents contained therein) is wasteful.

There is a need for improved detergent compositions having simple surfactant systems and encapsulates.

SUMMARY OF THE INVENTION

The present disclosure relates to liquid detergent compositions that include a surfactant system and encapsulates. The surfactant system may include an anionic alkoxylated alkyl sulphate surfactant.

The present disclosure also relates to a liquid detergent composition including from about 5 to about 60%, by weight of the detergent composition, of a surfactant system, where the surfactant system includes an anionic alkoxylated alkyl sulphate surfactant present at a level of about 70% to 100%, by weight of the surfactant system, and where the composition further includes from about 0.1% to about 5%, by weight of the composition, of encapsulates, where the encapsulates include a core and a wall at least partially surrounding the core, where the core comprises a benefit agent, and where the wall includes a coating on an outer surface of the wall.

The present disclosure further relates to methods of making and using such detergent compositions. For example, the present disclosure relates to a method of treating a fabric, where the method includes the step of contacting a fabric with a detergent composition of the present disclosure.

BRIEF DESCRIPTION OF THE DRAWINGS

The figures herein are illustrative in nature and are not intended to be limiting.

FIG. 1 shows an encapsulate 10 according to the present disclosure.

DETAILED DESCRIPTION OF THE INVENTION

It has been surprisingly been found that a detergent composition that is rich in anionic alkyl alkoxylated sulphate surfactant and contains coated encapsulates provides improved performance compared to other surfactant systems. Without wishing to be bound by theory, it is believed that the surfactant composition interacts with the coating on the capsule wall, and a high level of alkyl alkoxylated sulphate is particularly effective at increasing encapsulate retention through the wash process.

The components of the compositions and processes of the present disclosure are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Liquid Detergent Composition

The present disclosure relates to detergent compositions. The detergent compositions may be fabric care compositions. The compositions may be used as a pre-laundering treatment or during the wash cycle. The liquid detergent composition may be a heavy duty laundry detergent. TIDE, GAIN, and ARIEL are brand-name examples of commercially available heavy duty laundry detergents, available from The Procter & Gamble Company (Cincinnati, Ohio, USA).

The detergent composition may be a liquid. The liquid detergent may have a viscosity from about 1 to about 2000 centipoise (1-2000 mPa·s), or from about 200 to about 800 centipoise (200-800 mPa·s). The viscosity is determined using a Brookfield viscometer, No. 2 spindle, at 60 RPM/s, measured at 25° C.

The detergent composition may be in unit dose form. A unit dose article is intended to provide a single, easy to use dose of the composition contained within the article for a particular application. The unit dose form may be a pouch or a water-soluble sheet. A pouch may comprise at least one, or at least two, or at least three compartments. Typically, the detergent composition is contained in at least one of the compartments. The compartments may be arranged in superposed orientation, i.e., one positioned on top of the other, where they may share a common wall. At least one compartment may be superposed on another compartment. Alternatively, the compartments may be positioned in a side-by-side orientation, i.e., one orientated next to the other. The compartments may even be orientated in a 'tire and rim' arrangement, i.e., a first compartment is positioned next to a second compartment, but the first compartment at least partially surrounds the second compartment, but does not completely enclose the second compartment. Alternatively, one compartment may be completely enclosed within another compartment.

The unit dose form may comprise water-soluble film that forms the compartment and encapsulates the detergent composition. Preferred film materials are polymeric materials; for example, the water-soluble film may comprise polyvinyl alcohol. The film material can, for example, be obtained by casting, blow-molding, extrusion, or blown extrusion of the polymeric material, as known in the art. Suitable films include those supplied by MonoSol (Merrillville, Ind., USA) under the trade references M8630, M8900, M8779, M8310, and M9467. The films and/or the compositions contained therein may include an aversive agent, such as denatonium benzoate, to deter ingestion.

The detergent composition may comprise water. The composition may comprise from about 1% to about 80%, by weight of the composition, water. When the composition is a heavy duty liquid detergent composition, the composition typically comprises from about 40% to about 80% water. When the composition is a compact liquid detergent, the composition typically comprises from about 20% to about 60%, or from about 30% to about 50% water. When the composition is in unit dose form, for example, encapsulated in water-soluble film, the composition typically comprises less than 20%, or less than 15%, or less than 12%, or less than 10%, or less than 8%, or less than 5% water. The composition may comprise from about 1% to 20%, or from about 3% to about 15%, or from about 5% to about 12%, by weight of the composition, water.

Surfactant System

The detergent compositions of the present disclosure may comprise a surfactant system. It has surprisingly been found that careful selection of the surfactant can provide improved deposition of encapsulates onto a surface, such as fabric.

The surfactant systems described herein may be relatively simple in that they comprise a majority (although not necessarily entirely) of a single surfactant type. The surfactant systems may comprise no more than three surfactants, or no more than two surfactants, or even no more than one surfactant.

The detergent compositions of the present disclosure may comprise from about 5% to about 60%, by weight of the detergent composition, of a surfactant system. The detergent composition may comprise from about 5%, or from about 10%, or from about 15%, to about 60%, or to about 50%, or to about 30%, or to about 25%, or to about 20%, by weight of the detergent composition, of a surfactant system. As used herein, fatty acid and/or salts thereof are not considered part of the surfactant system.

Alkoxylated Alkyl Sulphate Surfactant

The detergent composition may comprise a detersive anionic surfactant. The anionic surfactant may comprise alkoxylated alkyl sulphate surfactant. The alkoxylated alkyl sulphate surfactant may be present as a major portion of the surfactant system. As further described herein, it is believed that a detergent rich in such a surfactant provides improved deposition of encapsulates onto target surfaces.

The alkoxylated alkyl sulphate surfactant may be present in the detergent composition at a level of from about 80%, or from about 85%, or from about 90%, or from about 95%, or from about 98%, to about 100%, by weight of the surfactant system.

The alkoxylated alkyl sulphate surfactant may comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric reaction products having in their molecular structure an alkyl group containing from about 8 to about 30 carbon atoms and a sulfonic acid and its salts. (Included in the term "alkyl" is the alkyl portion of acyl groups.)

The alkyl group may have from about 8 to about 20 carbon atoms, or from about 10, or from about 12, to about 18, or to about 16, or to about 14, carbon atoms. The anionic alkoxylated alkyl sulphate surfactant may include an alkoxylated C10-C16, preferably C12-C16, more preferably C12-C14, sulphate surfactant.

The alkoxylated alkyl sulfate surfactant may be a mixture of alkoxylated alkyl sulfates, where the mixture has an average (arithmetic mean) carbon chain length within the range of about 8 to about 30 carbon atoms, or of about 8 to about 20, or of about 10 to about 16, or of about 12 to about 16, or of about 12 to about 14, carbon atoms.

The alkoxylated alkyl sulfate surfactant may have an average (arithmetic mean) degree of alkoxylation of from about 1 mol to about 5 mols of alkoxy groups. The ethoxylated alkyl sulfate surfactant may have an average (arithmetic mean) degree of ethoxylation of from about 1 mol to about 5 mols, or of about 1 to about 4, or of about 1 to about 3, or of from about 1.5 to about 3, of ethoxy groups. In other words, the sulphate surfactant may have an average degree of ethoxylation of from about 1 to about 5, or from about 1 to about 4, or from about 1 to about 3, or from about 1.5 to about 3. The average degree of ethoxylation may be about 1.8, or it may be about 3.

The anionic alkoxylated alkyl sulphate surfactant may be a C12-C15, or C12-C14 sulphate surfactant having a degree of ethoxylation of about 1.5 to about 3.

Other Surfactants

The surfactant system may contain minor portions of other surfactants. The other surfactants may be intentionally added for performance reasons, or they may be added to the composition as trace/carrier ingredients of other adjuncts.

The surfactant system may comprise less than about 30%, or less than 20%, or less than about 15% or less than about 10%, or less than about 5%, or less than about 2%, by weight of the surfactant system, of other surfactants, if any (i.e., 0%). The surfactants may be selected from detersive surfactants selected from anionic surfactants, nonionic surfactants, cationic surfactants, zwitterionic surfactants, amphoteric surfactants, ampholytic surfactants, and mixtures thereof. Those of ordinary skill in the art will understand that a detersive surfactant encompasses any surfactant or mixture of surfactants that provide cleaning, stain removing, or laundering benefit to soiled material.

Anionic surfactants may include non-alkoxylated alkyl sulphate surfactants, such as those produced by the sulfation of higher $C_8$-$C_{20}$ fatty alcohols. Primary alkyl sulfate surfactants may have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium. The detergent compositions described herein may include no more than 5%, by weight of the surfactant system, if any, of a non-alkoxylated alkyl sulphate surfactant.

Other anionic surfactants may include the alkali metal salts and/or (alkylol)amine salts of alkyl benzene sulfonates, in which the alkyl group contains from about 9 to about 15 carbon atoms, in straight chain (linear) or branched chain configuration. The alkyl group may be linear. Such linear alkylbenzene sulfonates are known as "LAS." The linear alkylbenzene sulfonate may have an average number of carbon atoms in the alkyl group of from about 11 to 14. The linear straight chain alkyl benzene sulfonates may have an average number of carbon atoms in the alkyl group of about 11.8 carbon atoms, which may be abbreviated as C11.8 LAS. The detergent compositions described herein may include no more than about 20%, or no more than about 10%, or no more than about 5%, by weight of the surfactant system, if any, of an alkyl sulphonate surfactant, such as alkyl benzene sulphonate surfactant, e.g., linear alkyl benzene sulphonate surfactant.

Suitable nonionic surfactants useful herein can comprise any conventional nonionic surfactant. These may include alkoxylated nonionic surfactants and amine oxide surfactants. The detergent compositions described herein may include no more than 5%, by weight of the surfactant system, if any, of nonionic surfactant.

Alkoxylated nonionic surfactants may include the ethoxylated alcohols and ethoxylated alkyl phenols. The nonionic surfactants may be of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. The nonionic surfactant may be a nonionic alkoxylated fatty alcohol surfactant, preferably a nonionic ethoxylated fatty alcohol surfactant. The nonionic surfactant may have an average of from about 12 to about 14 carbon atoms, and an average degree of ethoxylation of about 7 to about 9 moles of ethylene oxide per mole of alcohol.

Other non-limiting examples of nonionic surfactants useful herein include: $C_{12}$-$C_{18}$ alkyl ethoxylates, such as, NEODOL® nonionic surfactants from Shell; $C_6$-$C_{12}$ alkyl phenol alkoxylates wherein the alkoxylate units are a mixture of ethyleneoxy and propyleneoxy units; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, $BAE_x$, wherein x is from 1 to 30; alkylpolysaccharides; alkylpolyglycosides; polyhydroxy fatty acid amides; and ether capped poly(oxyalkylated) alcohol surfactants; and mixtures thereof.

Encapsulates

The detergent compositions of the present disclosure may comprise encapsulates. As schematically shown in FIG. 1, an encapsulate 10 may include a core 30 and a wall 20 at least partially surrounding the core 30. The core 30 may include a benefit agent, such as perfume. The wall 20 may include an outer surface 25, which may include a coating 40. The coating may include an efficiency polymer. These elements are discussed in more detail below.

The composition may comprise from about 0.1%, or from about 0.2%, or from about 0.3%, or from about 0.4%, or from about 0.5%, to about 5%, or to about 2.5%, or to about 2%, or to about 1%, by weight of the composition, of encapsulates. The composition may include from a bout 0.1% to about 1% of encapsulates.

The encapsulates may be friable. The encapsulates particle size can be measured by typical methods known in the art such as with a Malvern particle sizer. The encapsulates may have a mean particle size of from about 10 microns to about 500 microns, or to about 200 microns, or to about 100 microns, or to about 50 microns, or to about 30 microns. A plurality of encapsulates may form aggregates.

The encapsulates may have a cationic charge at a pH range from about 2 to about 10, from about 3 to about 9, or from about 4 to about 8.

The encapsulate may have a wall, which may at least partially surround the core. The wall may include a wall material selected from the group consisting of polyethylenes; polyamides; polystyrenes; polyisoprenes; polycarbonates; polyesters; polyacrylates; acrylics; aminoplasts; polyolefins; polysaccharides, such as alginate and/or chitosan; gelatin; shellac; epoxy resins; vinyl polymers; water insoluble inorganics; silicone; and mixtures thereof. The wall material may be selected from the group consisting of an aminoplast, an acrylic, an acrylate, and mixtures thereof.

The wall material may include an aminoplast. The aminoplast may include a polyurea, polyurethane, and/or polyureaurethane. The aminoplast may include an aminoplast copolymer, such as melamine-formaldehyde, urea-formaldehyde, cross-linked melamine formaldehyde, or mixtures thereof. The wall material may include melamine formaldehyde, and the wall may further include a coating as described below. The encapsulate may include a core that comprises perfume, and a wall that includes melamine formaldehyde and/or cross linked melamine formaldehyde. The encapsulate may include a core that comprises perfume, and a wall that comprises melamine formaldehyde and/or cross linked melamine formaldehyde, poly(acrylic acid) and poly(acrylic acid-co-butyl acrylate).

The outer wall of the encapsulate may include a coating. Certain coatings may improve deposition of the encapsulate onto a target surface, such as a fabric. The encapsulate may have a coating-to-wall weight ratio of from about 1:200 to about 1:2, or from about 1:100 to about 1:4, or even from about 1:80 to about 1:10.

The coating may comprise an efficiency polymer. The coating may comprise a cationic efficiency polymer. The cationic polymer may be selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof. The coating may comprise a polymer selected from the group consisting of polyvinyl amines, polyvinyl formamides, polyallyl amines, copolymers thereof, and mixtures thereof.

The coating may comprise polyvinyl formamide. The polyvinyl formamide may have a hydrolysis degree of from about 5% to about 95%, from about 7% to about 60%, or even from about 10% to about 40%.

One or more of the efficiency polymers may have an average molecular mass from about 1,000 Da to about 50,000,000 Da, from about 5,000 Da, to about 25,000,000 Da, from about 10,000 Da to about 10,000,000 Da, or even from about 340,000 Da to about 1,500,000 Da. One or more of the efficiency polymers may have a charge density from about 1 meq/g efficiency polymer to about 23 meq/g efficiency polymer, from about 1.2 meq/g efficiency polymer and 16 meq/g efficiency polymer, from about 2 meq/g efficiency polymer to about 10 meq/g efficiency polymer, or even from about 1 meq/g efficiency polymer to about 4 meq/g efficiency polymer.

The core of the encapsulate may include a benefit agent. Suitable benefit agents may include perfume raw materials, silicone oils, waxes, hydrocarbons, higher fatty acids, essential oils, lipids, skin coolants, vitamins, sunscreens, antioxidants, glycerine, catalysts, bleach particles, silicon dioxide particles, malodor reducing agents, odor-controlling materials, chelating agents, antistatic agents, softening agents, insect and moth repelling agents, colorants, antioxidants, chelants, bodying agents, drape and form control agents, smoothness agents, wrinkle control agents, sanitization agents, disinfecting agents, germ control agents, mold control agents, mildew control agents, antiviral agents, drying agents, stain resistance agents, soil release agents, fabric refreshing agents and freshness extending agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, anti-pilling agents, defoamers, anti-foaming agents, UV protection agents, sun fade inhibitors, anti-allergenic agents, enzymes, water proofing agents, fabric comfort agents, shrinkage resistance agents, stretch resistance agents, stretch recovery agents, skin care agents, glycerin, and natural actives, antibacterial actives, antiperspirant actives, cationic polymers, dyes and mixtures thereof. The benefit agent may include perfume raw materials.

The encapsulates may include a core that comprises perfume raw materials, and a wall that includes melamine formaldehyde and/or cross linked melamine formaldehyde, where the wall further comprises a coating on an outer surface of the wall, where the coating includes an efficiency polymer such as polyvinyl formamide.

Suitable encapsulates may be obtained from Encapsys (Appleton, Wis., USA). The detergent compositions may include mixtures of different encapsulates, for example encapsulates having different wall materials and/or benefit agents.

The present detergent compositions may further include formaldehyde scavengers. Such scavengers may be useful in or with certain encapsulates, particularly encapsulates that include and/or release formaldehyde. Suitable formaldehyde scavengers may include: sodium bisulfite, urea, cysteine, cysteamine, lysine, glycine, serine, carnosine, histidine, glutathione, 3,4-diaminobenzoic acid, allantoin, glycouril, anthranilic acid, methyl anthranilate, methyl 4-aminobenzoate, ethyl acetoacetate, acetoacetamide, malonamide, ascorbic acid, 1,3-dihydroxyacetone dimer, biuret, oxamide, benzoguanamine, pyroglutamic acid, pyrogallol, methyl gallate, ethyl gallate, propyl gallate, triethanol amine, succinamide, thiabendazole, benzotriazol, triazole, indoline, sulfanilic acid, oxamide, sorbitol, glucose, cellulose, poly(vinyl alcohol), poly(vinyl amine), hexane diol, ethylenediamine-N,N'-bisacetoacetamide, N-(2-ethylhexyl)acetoacetamide, N-(3-phenylpropyl)acetoacetamide, lilial, helional, melonal, triplal, 5,5-dimethyl-1,3-cyclohexanedione, 2,4-dimethyl-3-cyclohexenecarboxaldehyde, 2,2-dimethyl-1,3-dioxan-4,6-dione, 2-pentanone, dibutyl amine, triethylenetetramine, benzylamine, hydroxycitronellol, cyclohexanone, 2-butanone, pentane dione, dehydroacetic acid, chitosan, or mixtures thereof.

External Structuring System

The liquid detergent compositions of the present disclosure may include an external structuring system. The structuring system may be used to provide sufficient viscosity to the composition in order to provide, for example, suitable pour viscosity, phase stability, and/or suspension capabilities. The external structuring system may be particularly useful for suspending the encapsulates.

The composition of the present disclosure may comprise from 0.01% to 5% or even from 0.1% to 1% by weight of an external structuring system. The external structuring system may be selected from the group consisting of:

(i) non-polymeric crystalline, hydroxy-functional structurants and/or (ii) polymeric structurants.

Such external structuring systems may be those which impart a sufficient yield stress or low shear viscosity to stabilize a fluid laundry detergent composition independently from, or extrinsic from, any structuring effect of the detersive surfactants of the composition. They may impart to a fluid laundry detergent composition a high shear viscosity at 20 $s^{-1}$ at 21° C. of from 1 to 1500 cps and a viscosity at low shear ($0.055^{-1}$ at 21° C.) of greater than 5000 cps. The viscosity is measured using an AR 550 rheometer from TA instruments using a plate steel spindle at 40 mm diameter and a gap size of 500 μm. The high shear viscosity at 20 $s^{-1}$ and low shear viscosity at 0.5 $s^{-1}$ can be obtained from a logarithmic shear rate sweep from 0.1 $s^{-1}$ to 25 $s^{-1}$ in 3 minutes time at 21° C.

The compositions may comprise from about 0.01% to about 1% by weight of a non-polymeric crystalline, hydroxyl functional structurant. Such non-polymeric crystalline, hydroxyl functional structurants may comprise a crystallizable glyceride which can be pre-emulsified to aid dispersion into the final unit dose laundry detergent composition. Suitable crystallizable glycerides include hydrogenated castor oil or "HCO" or derivatives thereof, provided that it is capable of crystallizing in the liquid detergent composition.

The detergent composition may comprise from about 0.01% to 5% by weight of a naturally derived and/or synthetic polymeric structurant. Suitable naturally derived polymeric structurants include: cellulose fibers, hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Suitable cellulose fibers may comprise fibers having an aspect ratio (length to width ratio) from about 50 to about 100,000, preferably from about 300 to about 10,000 and include mineral fibers, fermentation derived cellulose fibers, fibers derived from mono- or di-cotyledons such as vegetables, fruits, seeds, stem, leaf and/or wood derived cellulose fibers and mixtures thereof. Commercially available examples are Avicel® from FMC, Citri-Fi from Fiberstar, Herbacel from Herbafood and Cellulon PX from CP Kelco. Suitable synthetic polymeric structurants include: polycarboxylates, polyacrylates and hydrophobically modified polyacrylates, hydrophobically modified ethoxylated urethanes, hydrophobically modified non-ionic polyols and mixtures thereof. The polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Such copolymers are available from Noveon inc under the tradename Carbopol® Aqua 30.

Fatty Acid and/or Salt Thereof

The detergent compositions of the present disclosure may comprise a fatty acid and/or its salt. Without wishing to be bound by theory, it is believed that in the present compositions, fatty acids and/or their salts act to build the detergent composition to complex hardness ions, participate in cleaning and stain removal, suspends soils, and suppress suds. However, fatty acid may not be required in the present compositions, and there may be processing, cost, and stability advantages to minimizing fatty acid levels, or even eliminating fatty acids completely.

The composition may comprise from about 0.1%, or from about 0.5%, or from about 1%, to about 20%, or to about 10%, or to about 8%, or to about 5%, or to about 4%, or to about 3%, or to about 2%, by weight of the composition, of fatty acid and/or its salt. The detergent composition may be substantially free (or even contain 0%) of fatty acids and their salts.

Suitable fatty acids and salts include those having the formula R1COOM, where R1 is a primary or secondary alkyl group of 4 to 30 carbon atoms, and where M is a hydrogen cation or another solubilizing cation. In the acid form, M is a hydrogen cation; in the salt form, M is a solubilizing cation that is not hydrogen. While the acid (i.e., wherein M is a hydrogen cation) is suitable, the salt is typically preferred since it has a greater affinity for the cationic polymer. Therefore, the fatty acid or salt may be selected such that the pKa of the fatty acid or salt is less than the pH of the non-aqueous liquid composition. The composition may have a pH of from 6 to 10.5, or from 6.5 to 9, or from 7 to 8.

The alkyl group represented by R1 may represent a mixture of chain lengths and may be saturated or unsaturated, although it is preferred that at least two thirds of the R1 groups have a chain length of between 8 and 18 carbon atoms. Non-limiting examples of suitable alkyl group sources include the fatty acids derived from coconut oil, tallow, tall oil, rapeseed-derived, oleic, fatty alkylsuccinic, palm kernel oil, and mixtures thereof. For the purposes of minimizing odor, however, it is often desirable to use primarily saturated carboxylic acids.

The solubilizing cation, M (when M is not a hydrogen cation), may be any cation that confers water solubility to the product, although monovalent moieties are generally preferred. Examples of suitable solubilizing cations for use with this disclosure include alkali metals such as sodium and potassium, which are particularly preferred, and amines such as monoethanolamine, triethanolammonium, ammonium, and morpholinium. Although, when used, the majority of the fatty acid should be incorporated into the composition in neutralized salt form, it is often preferable to leave an amount of free fatty acid in the composition, as this can aid in the maintenance of the viscosity of the composition, particularly when the composition has low water content, for example less than 20%.

Adjuncts

The detergent compositions of the present disclosure may include other suitable adjuncts, such as adjuncts that provide fabric care benefits. As the presently disclosed compositions may have surfactant systems that are rich in one particular surfactant, such adjuncts may be particularly desirable to provide a broader cleaning profile or other consumer-relevant benefits, such as softness benefits. Suitable adjuncts include enzymes, brighteners, cleaning polymers such as alkoxylated polyalkyleneimines, soil release polymers, hueing dyes, and combinations thereof. Typical usage levels range from as low as 0.001% by weight of composition for adjuncts such as optical brighteners or hueing dyes up to 50% by weight of composition for builders or solvents. Several suitable adjuncts are discussed in more details below.

Enzymes

The cleaning compositions of the present disclosure may comprise enzymes. Enzymes may be included in the cleaning compositions for a variety of purposes, including removal of protein-based, carbohydrate-based, or triglyceride-based stains from substrates, for the prevention of refugee dye transfer in fabric laundering, and for fabric restoration. Suitable enzymes include proteases, amylases, lipases, carbohydrases, cellulases, oxidases, peroxidases, mannanases, and mixtures thereof of any suitable origin, such as vegetable, animal, bacterial, fungal, and yeast origin. Other enzymes that may be used in the cleaning compositions described herein include hemicellulases, gluco-amylases, xylanases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidases, chondroitinases, laccases, or mixtures thereof. Enzyme selection is influenced by factors such as pH-activity and/or stability optima, thermostability, and stability to active detergents, builders, and the like.

In some aspects, lipase may be included. Additional enzymes that may be used in certain aspects include mannanase, protease, and cellulase. Mannanase, protease, and cellulase may be purchased under the trade names, respectively, Mannaway, Savinase, and Celluclean, from Novozymes (Denmark), providing, respectively, 4 mg, 15.8 mg, and 15.6 mg active enzyme per gram.

In some aspects, the composition comprises at least two, or at least three, or at least four enzymes. In some aspects, the composition comprises at least an amylase and a protease.

Enzymes are normally incorporated into cleaning compositions at levels sufficient to provide a "cleaning-effective amount." The phrase "cleaning effective amount" refers to any amount capable of producing a cleaning, stain removal, soil removal, whitening, deodorizing, or freshness improving effect on soiled material such as fabrics, hard surfaces, and the like. In some aspects, the detergent compositions may comprise from about 0.0001% to about 5%, or from about 0005% to about 3%, or from about 0.001% to about 2%, of active enzyme by weight of the cleaning composition. The enzymes can be added as a separate single ingredient or as mixtures of two or more enzymes.

Brighteners

The detergent compositions described herein may include an optical brightener. Optical brighteners, also known as fluorescent whitening agents, are well-known in the art. The detergent compositions of the present invention may comprise from about 0.005%, or from about 0.01%, to about 5%, or to about 1%, or to about 0.5%, by weight of the composition, of a brightener.

The optical brightener may be a substantially insoluble compound selected from compounds comprising stilbene, pyrazoline, coumarin, carboxylic acids, methinecyanines, dibenzothiophene-5,5-dioxide, azoles, 5- and 6-membered-ring heterocyclic, benzene or derivatives thereof and mixtures thereof. The brightener comprises a benzoxozol, pyrazole, triazole, triazine, imidazole, furan group or mixtures thereof.

Suitable brighteners include disodium 4,4'-bis {[4-anilino-6morpholino-s-triazin-2-yl]amino}-2,2'-stilbenedisulfonatedisodium 4,4'-bis-(2-sulfostryl)biphenyl; and disodium 4,4'-bis[{4,6-di-anilino-s-triazin-2-yl]-amino}-2,2' stilbene disulfonate. Commercially available brighteners include Brightener 15, Brightener 36, and Brightener 49, available from BASF.

Cleaning Polymers

The composition may include cleaning polymers. For example, the detergent composition may comprise amphiphilic alkoxylated grease cleaning polymers, which may have balanced hydrophilic and hydrophobic properties such that they remove grease particles from fabrics and surfaces. The amphiphilic alkoxylated grease cleaning polymers may comprise a core structure and a plurality of alkoxylate groups attached to that core structure. These may comprise alkoxylated polyalkyleneimines, for example. Such compounds may include, but are not limited to, ethoxylated polyethyleneimine, ethoxylated hexamethylene diamine, and sulfated versions thereof. Polypropoxylated derivatives may also be included. A wide variety of amines and polyalklyeneimines can be alkoxylated to various degrees. A useful example is 600 g/mol polyethyleneimine core ethoxylated to 20 EO groups per NH and is available from BASF. The alkoxylated polyalkyleneimines may have an inner polyethylene oxide block and an outer polypropylene oxide block. The detergent compositions described herein may comprise from about 0.1% to about 10%, and in some examples, from about 0.1% to about 8%, and in other examples, from about 0.1% to about 6%, by weight of the detergent composition, of alkoxylated polyamines.

Soil Release Polymers (SRPs)

The detergent compositions of the present disclosure may comprise a soil release polymer. In some aspects, the detergent compositions may comprise one or more soil release polymers having a structure as defined by one of the following structures (I), (II) or (III):

$$—[(OCHR^1—CHR^2)_a—O—OC—Ar—CO—]_d \quad (I)$$

$$—[(OCHR^3—CHR^4)_b—O—OC\text{-}sAr—CO—]_e \quad (II)$$

$$—[(OCHR^5—CHR^6)_c—OR^7]_f \quad (III)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$ n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN300 and SRN325 supplied by Clamant. Other suitable soil release polymers are Marloquest polymers, such as Marloquest SL supplied by Sasol.

Amines

The cleaning compositions described herein may contain an amine. Non-limiting examples of amines include, but are not limited to, etheramines, cyclic amines, polyamines, oligoamines (e.g., triamines, diamines, pentamines, tetraamines), or combinations thereof. The compositions described herein may comprise an amine selected from the group consisting of oligoamines, etheramines, cyclic amines, and combinations thereof.

The cleaning compositions may include from about 0.1% to about 10%, or from about 0.2% to about 5%, or from about 0.5% to about 4%, or from about 0.1% to about 4%, or from about 0.1% to about 2%, by weight of the composition, of an amine. The amine can be subjected to protonation depending on the pH of the cleaning medium in which it is used.

Examples of suitable oligoamines include tetraethylenepentamine, triethylenetetraamine, diethylenetriamine, and mixtures thereof. Etheramines and cyclic amines are described in more detail below.

Suitable etheramines may be represented by Formula (A):

Formula (A)

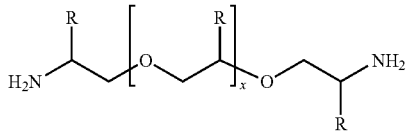

where each R group is independently selected from the group consisting of H, a methyl group, and an ethyl group, where at least one R group is a methyl group, x is in the range of about 2 to about 300. x indicates the average number of repeated units or basic building blocks that constitute the polymer. x may be a whole number or a fraction. x may be in the range of about 2 and about 20, or about 2 to about 10.

Suitable etheramines may be represented by Formula (I):

Formula (I)

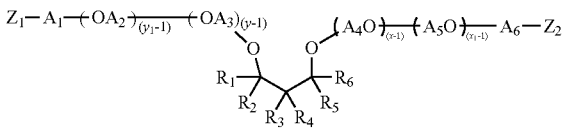

where each of $R_1$-$R_6$ is independently selected from H, alkyl, cycloalkyl, aryl, alkylaryl, or arylalkyl, where at least one of $R_1$-$R_6$ is different from H, typically at least one of $R_1$-$R_6$ is an alkyl group having 2 to 8 carbon atoms, each of $A_1$-$A_6$ is independently selected from linear or branched alkylenes having 2 to 18 carbon atoms, each of $Z_1$-$Z_2$ is independently selected from OH or $NH_2$, where at least one of $Z_1$-$Z_2$ is $NH_2$, typically each of $Z_1$ and $Z_2$ is $NH_2$, where the sum of x+y is in the range of about 2 to about 200, or about 2 to about 20, or about 2 to about 10, or about 2 to about 8, or about 3 to about 8, or about 4 to about 6, where x≥1 and y≥1, and the sum of $x_1+y_1$ is in the range of about 2 to about 200, or about 2 to about 20, or about 2 to about 10, or about 2 to about 8, or about 3 to about 8, or about 2 to about 4, where $x_1 \geq 1$ and $y_1 \geq 1$.

In the etheramine of Formula (I), each of $A_1$-$A_6$ may be independently selected from ethylene, propylene, or butylene; typically, each of $A_1$-$A_6$ is propylene. Each of $A_1$ and $A_6$ may be independently selected from linear alkanediyl groups having 2 to 18 carbon atoms, or 2-10 carbon atoms, or 2-5 carbon atoms; each of $A_2$, $A_3$, $A_4$, and $A_5$ may be independently selected from linear or branched alkanediyl groups having 2 to 18 carbon atoms, or 2-10 carbon atoms, or 2-5 carbon atoms. In the etheramine of Formula (I), each of $R_1$, $R_2$, $R_5$, and $R_6$ may be H and each of $R_3$ and $R_4$ may be independently selected from C1-C16 alkyl or aryl; typically each of $R_1$, $R_2$, $R_5$, and $R_6$ may be H and each of $R_3$ and $R_4$ may be independently selected from a butyl group, an ethyl group, a methyl group, a propyl group, or a phenyl group. In the etheramine of Formula (I), $R_3$ may be an ethyl group, each of $R_1$, $R_2$, $R_5$, and $R_6$ may be H, and $R_4$ may be a butyl group. In the etheramine of Formula (I), each of $R_1$ and $R_2$ may be H and each of $R_3$, $R_4$, $R_5$, and $R_6$ may be independently selected from an ethyl group, a methyl group, a propyl group, a butyl group, a phenyl group, or H.

Suitable etheramines may be represented by Formula (II):

Formula (II)

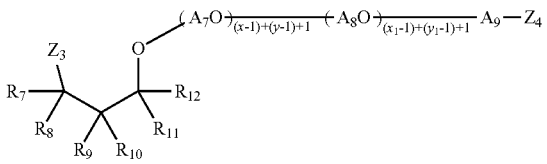

each of $R_7$-$R_{12}$ is independently selected from H, alkyl, cycloalkyl, aryl, alkylaryl, or arylalkyl, where at least one of $R_7$-$R_{12}$ is different from H, typically at least one of $R_7$-$R_{12}$ is an alkyl group having 2 to 8 carbon atoms, each of $A_7$-$A_9$ is independently selected from linear or branched alkylenes having 2 to 18 carbon atoms, each of $Z_3$-$Z_4$ is independently selected from OH or $NH_2$, where at least one of $Z_3$—$Z_4$ is $NH_2$, typically each of $Z_3$ and $Z_4$ is $NH_2$, where the sum of x+y is in the range of about 2 to about 200, or about 2 to about 20, or about 2 to about 10, or about 2 to about 8, or about 3 to about 8, or about 2 to about 4, where x≥1 and y≥1, and the sum of $x_1+y_1$ is in the range of about 2 to about 200, or about 2 to about 20, or about 2 to about 10, or about 2 to about 8, or about 3 to about 8, or about 2 to about 4, where $x_1 \geq 1$ and $y_1 \geq 1$.

In the etheramine of Formula (II), each of $A_7$-$A_9$ may be independently selected from ethylene, propylene, or butylene; typically each of $A_7$-$A_9$ may be propylene. $A_9$ may be selected from linear alkanediyl groups having 2 to 18 carbon atoms, or 2-10 carbon atoms, or 2-5 carbon atoms; each of $A_7$ and $A_8$ may be independently selected from linear or branched alkanediyl groups having 2 to 18 carbon atoms, or 2-10 carbon atoms, or 2-5 carbon atoms. In the etheramine of Formula (II), each of $R_7$, $R_8$, $R_{11}$, and $R_{12}$ may be H and each of $R_9$ and $R_{10}$ may be independently selected from C1-C16 alkyl or aryl; typically each of $R_7$, $R_8$, $R_{12}$, and $R_{12}$ may be H and each of $R_9$ and $R_{10}$ may be independently selected from a butyl group, an ethyl group, a methyl group, a propyl group, or a phenyl group. In the etheramine of Formula (II), $R_9$ is an ethyl group, each of $R_7$, $R_8$, $R_{11}$, and $R_{12}$ may be H, and $R_{10}$ may be a butyl group. In the etheramine of Formula (II), each of $R_7$ and $R_8$ may be H and each of $R_9$, $R_{10}$, $R_{11}$, and $R_{12}$ may be independently selected from an ethyl group, a methyl group, a propyl group, a butyl group, a phenyl group, or H.

Suitable etheramines are further described in US2014/0296127A1 and US2015/0057212A1.

Suitable cyclic amines may be represented by Formula (B):

Formula (B)

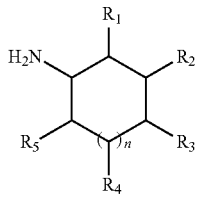

The substituents "Rs" can be independently selected from $NH_2$, H and linear, branched alkyl or alkenyl from 1 to 10 carbon atoms. For the purpose of this invention "Rs" includes R1-R5. At least one of the "Rs" needs to be $NH_2$. The remaining "Rs" can be independently selected from $NH_2$, H and linear, branched alkyl or alkenyl having from 1 to 10 carbon atoms. n is from 0 to 3, or n is 1.

Hueing Agents

The composition may comprise a fabric hueing agent (sometimes referred to as shading, bluing, or whitening agents). Typically the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Other Adjuncts

The compositions described herein may include other adjunct materials, which may be suitable for laundry processes. Suitable adjuncts include builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, for example PEI600 EO20 (ex BASF), polymeric soil release agents, polymeric dispersing agents, polymeric grease cleaning agents, brighteners, suds suppressors, dyes, perfume, structure elasticizing agents, fabric softeners, carriers, fillers, hydrotropes, organic solvents, anti-microbial agents and/or preservatives, neutralizers and/or pH adjusting agents, processing aids, opacifiers, pearlescent agents, pigments, or mixtures thereof.

The detergent compositions of the present disclosure may include a cationic deposition aid polymer. Cationic deposition aid polymers are sometimes used in detergent composition to facilitate deposition of components to a target surface. The deposition aid polymer may be a non-polysaccharide polymer. The deposition aid polymer may have a relatively low weight-average molecular weight, for example from about 5 kDa, or from about 10 kDa, or from about 15 kDa, to about 200 kDa, or to about 150 kDa, or to about 100 kDa, or to about 75 kDa, or to about 50 kDa, or to about 35 kDa, or to about 25 kDa. Weight-average molecular weight is determined with by Size Exclusion Chromatography (SEC) with differential refractive index detection (RI), used according to the manufacturer's instructions. The deposition aid polymer may include cationic monomeric units, cationic monomeric units derived from, for example, diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof. The salts of such monomeric units may be chloride salts (e.g., DADMAC). The cationic structural unit may be present in the polymer at a level of from about 50 mol %, or from about 60 mol %, or from about 70 mol %, or from about 75 mol %, to about 100 mol %, or to about 95 mol %, or to about 90 mol %, or to about 85 mol %. The deposition aid polymer may include nonionic monomeric units, such as monomeric units derived from acrylamide and/or methacrylamide (together, "(meth)acrylamide"). The nonionic structural unit may be present in the polymer at a level of from about 0 mol %, or from about 5 mol %, or from about 10 mol %, or from about 15 mol %, to about 50 mol %, or to about 40 mol %, or to about 30 mol %. The deposition aid polymer may further include anionic monomeric units. The deposition aid may be cationic copolymer comprising (meth) acrylamide and DADMAC.

The detergent compositions described herein may contain no more than 0.1%, if any, of a cationic deposition aid polymer, excluding any cationic polymer that may be part of the coating of the encapsulate, as the surfactant system is carefully selected to facilitate deposition of, e.g., encapsulates. The detergent compositions described herein may be substantially free, e.g., contain 0%, of a cationic deposition aid polymer. For clarity, any cationic polymer that is part of the coating of the encapsulate is not to be included in the calculation of the amount of cationic deposition aid polymer. Such deposition aid polymers may include cationic polysaccharides, such as cationic hydoxyethylcellulose, or cationic synthetic polymers that contain cationic monomeric units, such as cationic monomeric units derived from, for example, diallyl dimethyl ammonium salts (DADMAS), acrylamidopropyl trimethyl ammonium salts (APTAS), methacrylamidopropyl trimethylammonium salts (MAPTAS), quaternized vinylimidazole (QVi), and mixtures thereof. As used herein, cationic deposition aid polymers are not to include cleaning polymers, such as (alkoxylated) polyethyleneimine polymers.

The detergent compositions described herein may include from about 0.1% to about 10%, or from about 1% to about 5%, by weight of the composition, of a silicone, such as aminosilicone. Such silicones may provide feel/softness benefits to fabrics. However, silicones may also contribute to cleaning and/or whiteness losses on fabrics. Therefore, the detergent compositions may be substantially free (e.g., contain less than 0.3%, less than 0.1%, less than 0.01%, or even 0%) of silicone such as aminosilicone. It is recognized that silicones may be present in a detergent as a suds suppressor; therefore, the detergent may include low levels of silicones, where the level is sufficient to provide at least some anti-foam benefits, but not sufficient to provide a consumer-noticeable softness benefit. The detergent manufacturer may elect to include or exclude silicones, depending on the desired benefits.

Methods of Making the Detergent Composition

The detergent compositions of the present disclosure may be made by conventional methods, including batch or continuous loop processes. When an external structuring system is used, the external structuring system may be added to a base detergent after the encapsulates are added, and then mixed.

Methods of Using the Detergent Composition

The present disclosure relates to a method of pretreating or treating a surface, such as a fabric, where the method includes the step of contacting the surface (e.g., fabric) with the detergent composition described herein. The contacting step may occur in the presence of water, where the water and the detergent composition form a wash liquor. The contacting may occur during a washing step, and water may be added before, during, or after the contacting step to form the wash liquor.

The washing step may be followed by a rinsing step. During the rinsing step, the fabric may be contacted with a fabric softening composition, wherein said fabric softening composition comprises a fabric softening active. The fabric softening active of the methods described herein may comprise a quaternary ammonium compound, silicone, fatty acids or esters, sugars, fatty alcohols, alkoxylated fatty alcohols, polyglycerol esters, oily sugar derivatives, wax emulsions, fatty acid glycerides, or mixtures thereof. Suitable commercially available fabric softeners may also be used, such those sold under the brand names DOWNY®, LENOR® (both available from The Procter & Gamble Company), and SNUGGLE® (available from The Sun Products Corporation). The step of contacting the fabric with a fabric softening composition may occur in the presence of water, for example during a rinse cycle of an automatic washing machine.

Any suitable washing machine may be used, for example, a top-loading or front-loading automatic washing machine. Those skilled in the art will recognize suitable machines for the relevant wash operation. The compositions of the present disclosure may be used in combination with other compositions, such as fabric additives, fabric softeners, rinse aids, and the like.

Additionally, the detergent compositions of the present disclosure may be used in known methods where a surface is treated/washed by hand.

COMBINATIONS

Specifically contemplated combinations of the disclosure are herein described in the following lettered paragraphs. These combinations are intended to be illustrative in nature and are not intended to be limiting.

A. A liquid detergent composition comprising: from about 5 to about 60%, by weight of the detergent composition, of a surfactant system, wherein the surfactant system comprises an anionic alkoxylated alkyl sulphate surfactant present at a level of about 70% to 100%, by weight of the surfactant system, and from about 0.1% to about 5%, by weight of the composition, of encapsulates, wherein the encapsulates comprise a core and a wall at least partially surrounding the core, wherein the core comprises a benefit agent, and wherein the wall comprises a coating on an outer surface of the wall.

B. A detergent composition according to paragraph B, wherein the composition comprises from about 8%, or from about 10% to about 30%, or from about 15% to about 25%, or from about 15% to about 20%, by weight of the detergent composition, of a surfactant system.

C. A detergent composition according to paragraphs A or B, wherein the composition comprises from about 75% to about 100%, or from about 80% to about 100%, or from about 85% to about 95%, by weight of the surfactant system, of an anionic alkoxylated alkyl sulphate surfactant.

D. A detergent composition according to any of paragraphs A-C, wherein the anionic alkoxylated alkyl sulphate surfactant comprises an anionic ethoxylated alkyl sulphate surfactant.

E. A detergent composition according to any of paragraphs A-D, wherein the anionic ethoxylated alkyl sulphate surfactant has an average degree of ethoxylation of from about 1 to about 5, preferably from about 1 to about 3.

F. A detergent composition according to any of paragraphs A-E, wherein the anionic alkoxylated alkyl sulphate surfactant comprises an alkoxylated C10-C16, preferably C12-C16, more preferably C12-C14, sulphate surfactant.

G. A detergent composition according to any of paragraphs A-F, wherein the surfactant system comprises from about 74% to 100%, by weight of the surfactant system, of the anionic alkoxylated alkyl sulphate surfactant.

H. A detergent composition according to any of paragraphs A-G, wherein the surfactant system comprises no more than 20%, by weight of the surfactant system, if any, of an alkyl sulphonate surfactant, preferably alkyl benzene sulphonate surfactant, more preferably linear alkyl benzene sulphonate surfactant.

I. A detergent composition according to any of paragraphs A-H, wherein the surfactant system comprises no more than 5%, by weight of the surfactant system, if any, of a nonionic surfactant, preferably a nonionic alkoxylated fatty alcohol surfactant, more preferably a nonionic ethoxylated fatty alcohol surfactant.

J. A detergent composition according to any of paragraphs A-I, wherein the composition comprises from about 0.1% to about 1% of the encapsulates.

K. A detergent composition according to any of paragraphs A-J, wherein the benefit agent comprises perfume raw materials.

L. A detergent composition according to any of paragraphs A-K, wherein the coating comprises a cationic efficiency polymer, preferably a cationic efficiency polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof.

M. A detergent composition according to any of paragraphs A-L, wherein the coating comprises a cationic efficiency polymer selected from polyvinyl amines, polyvinyl formamides, polyallyl amines, copolymers thereof, and mixtures thereof, preferably polyvinyl formamide.

N. A detergent composition according to any of paragraphs A-M, wherein the wall comprises a wall material selected from the group consisting of aminoplast copolymer, an acrylic, an acrylate, and mixtures thereof.

O. A detergent composition according to any of paragraphs A-N, wherein the wall material comprises an aminoplast copolymer, preferably an aminoplast copolymer selected from melamine-formaldehyde, urea-formaldehyde, cross-linked melamine formaldehyde, or mixtures thereof.

P. A detergent composition according to any of paragraphs A-O, wherein the composition further comprises an external structurant.

Q. A detergent composition according to any of paragraphs A-P, wherein the composition further comprises a fatty acid or salt thereof.

R. A detergent composition according to any of paragraphs A-Q, wherein the composition further comprises an adjunct selected from an enzyme, a brightener, a cleaning polymer, an amine, a hueing dye, or combinations thereof.

S. A method of treating a fabric, said method comprising the step of contacting a fabric with a detergent composition according to any of paragraphs A-R.

TEST METHODS

Fabric Treatment Method

Before testing for encapsulate deposition and headspace, the test fabrics are prepared and treated according to one of the procedures described below. Fabrics are typically "de-sized" and/or "stripped" of any manufacturer's finish that may be present (according to A, below), dried, and then treated with a detergent composition in either a top-loading machine or a front-loading machine (according to B1 or B2, below).

A. Fabric De-Sizing Method.

New fabrics are de-sized by washing two cycles with 49° C. (120° F.), using zero grain water in a top loading washing machine such as Kenmore 80 series. All fabrics are tumble-dried after the second cycle for 45 minutes on cotton/high setting in a Kenmore series dryer.

B1. Fabric Treatment Method in a Top Loading Washing Machine.

De-sized fabrics are treated with a detergent composition using the standard wash setting on a top-loading National NA-FV8100 washing machine. The machine uses a 49 L fill volume with a 12 minute wash cycle, 2 rinse cycles, and 1-3 min spin cycle using 27° C. (81° F.) water for both the wash and rinse cycles. The wash and rinse cycles use 6 grain per gallon water. The detergent composition (52.5 g) is added to the washing machine drum after the water is filled at the beginning of the wash cycle, and then 2.9 kg of de-sized 100% cotton terry towels (30.5 cm×30.5 cm, RN37000-ITL available from Calderon Textiles, LLC 6131 W 80th St Indianapolis Ind. 46278) are added to the drum of the machine after it is filled with water. Treated fabrics are dried in a constant temperature and humidity room at 50% RH and 21° C. (70° F.) for 22-26 h.

B2. Fabric Treatment Method in a Front Loading Machine.

De-sized fabrics are treated with compositions of the present disclosure by dispensing the detergent compositions into the wash cycle of a front-loading washing machine such as a Whirlpool Duet Model 9200 (Whirlpool, Benton Harbor, Mich., USA). The detergent composition (61.5 g) is added to the dosing drawer of the washing machine, and 3.6 kg of de-sized 100% cotton terry towels (32 cm×32 cm, such as RN37002LL from Calderon Textiles, Indianapolis, Ind., USA) are added to the drum of the machine. The de-sized fabrics are treated with a detergent composition using the normal cycle with 18.9 L of water with 120 mg/L of calcium carbonate equivalents and 32° C. wash temperature and 16° C. rinse temperature. Treated fabrics are dried using a standard US tumble dryer such as Kenmore series dryer on the cotton/high setting for 45 minutes.

Fabric Headspace Analysis Method

Fabric headspace analysis is performed using Solid-phase Micro Extraction Gas Chromatography Mass Spectrometry (SPME GC-MS) described below. Typically, greater perfume intensity (as measured by headspace analysis) correlates with higher concentrations of perfume encapsulates on fabric. Perfume encapsulate headspace analysis is carried out on treated 100% cotton terry towels (30.5 cm×30.5 cm, RN37000ITL, Calderon Textiles, LLC, Indianapolis, Ind., USA) that have been prepared and treated according to the fabric preparation method that is described above.

Headspace analysis is done on six treated fabrics from two different wash cycles for a total of twelve fabrics. Each treated fabric is die-cut into ten 1.4 cm-diameter circle test specimens using a pneumatic press (Atom Clicker Press SE20C available from Manufacturing Suppliers Services, Cincinnati, Ohio). The ten test specimens are placed into a 20 mL headspace sample vial (#24694, available from Restek, Bellefonte, Pa.), the weight is recorded (ten 1.4 cm circles weigh about 0.70 g±0.07 g), and the vial is capped (#093640-094-00 available from Gerstel, Linthicum, Md.).

The samples vials are then loaded onto a Gerstel MPS2 Autosampler (Gerstel Inc., Linthicum, Md., USA). Prior to the headspace analysis, each sample is pre-conditioned in the machine at 65° C. for 10 minutes. Headspace is extracted onto an Agilent 7890B/5977A GC-MS system (Agilent Technologies, Santa Clara, Calif., USA) equipped with a Supelco 50/30 micrometer DVB/CAR/PDMS 23Ga. Solid Phase Micro Extraction fiber (Supelco Inc., Bellefonte, Pa., USA). GC analysis is conducted on a non-polar capillary column (DB-5MS UI, 30 meters nominal diameter, 0.25 millimeter nominal diameter, 25 micrometer thickness) and the headspace constituents (i.e. the perfume raw materials) are monitored by Mass Spectrometry (EI, 70 eV detector). Headspace intensity is calculated utilizing a single point calibration of the perfume raw materials. The total headspace concentration for each vial is calculated from the sum of the concentration of each detected perfume raw material, and the headspace is averaged for the twelve treated fabrics. Headspace improvement may be determined relative to the reference treatment.

Encapsulate Deposition Method

The determination of the amount of encapsulates deposited onto treated fabric requires the extraction of the perfume from the encapsulates. The extraction of the perfume microcapsules is performed using an Accelerated Solvent Extractor (Dionex ASE 350 (Thermo Scientific, Sunnyvale, Calif., USA) followed by GC-MS quantification described below. Two fabrics that have been analyzed using the headspace method above are removed from the headspace vial and placed into a 5 mL stainless steel extraction cell (#25997 & #25994, available from Restek, Bellefonte, Pa.), for a total mass of about 1.4 g (±0.14 g).

An equal mass of untreated fabric is spiked with a known amount of a known perfume mixture and analyzed to create a multipoint calibration. The perfume is extracted from the treated fabrics in the sealed extraction cell using the Dionex ASE 350 (Thermo Scientific, Sunnyvale, Calif., USA) method that utilizes methanol (6 mL) and heat (125° C.) in a 15-minute extraction. After 15 minutes, the solvent is purged from the cell with nitrogen into volatile organic analysis (VOA) vials (#12-100-102, available from Fisher Scientific, Pittsburgh, Pa., USA). A 500 microliter aliquot of the methanol collected in VOA vials is added to 4.5 mL of a 10% NaCl in deionized water solution (5 mL total solution) in a 20 mL headspace vial (#24694, available from Restek, Bellefonte, Pa.).

The sample vials containing the 5 mL of solution are then loaded onto a Gerstel MPS2 Autosampler (Gerstel Inc., Linthicum, Md., USA). Prior to the headspace analysis, each sample is pre-conditioned in the machine at 65° C. for 10 minutes. Headspace is extracted onto the Agilent 7890B/5977A GC-MS system (Agilent Technologies, Santa Clara, Calif., USA) equipped with a Supelco 100 micrometer PDMS 23Ga. Solid Phase Micro Extraction fiber (Supelco Inc., Bellefonte, Pa., USA). GC analysis is conducted on a non-polar capillary column (DB-5MS UI, 30 meters nominal diameter, 0.25 millimeter nominal diameter, 25 micrometer thickness) and the headspace constituents (i.e. the perfume raw materials) are monitored by Mass Spectrometry (EI, 70 eV detector). Perfume concentration is calculated utilizing a multi-point calibration of the perfume raw materials from the spiked fabrics. The total deposition is the sum of each detected perfume raw material divided by the mass of the fabric. Deposition efficiency is calculated by dividing the extracted perfume per gram of fabric by the total encapsulated perfume delivered to the washing machine divided by the total mass of the fabric load and is reported as a percentage.

EXAMPLES

Example 1—Detergent Formulations

Liquid detergent compositions are prepared by mixing the ingredients listed in the proportions shown in Table 1. Examples 1A and 1B are comparative examples, having major portions of the surfactant system that are not anionic alkoxylated alkyl sulphate surfactant (i.e., LAS and nonionic surfactant, respectively). Examples 1C and 1D are detergent compositions according to the present disclosure, having anionic alkoxylated alkyl sulphate surfactant as the major portion of the surfactant system. Each composition also contains coated encapsulates.

TABLE 1

| Ingredient (wt %) | 1A (comp.) | 1B (comp.) | 1C | 1D | 1E | 1F | 1G |
|---|---|---|---|---|---|---|---|
| Alkoxylated alkyl sulfate surfactant ($C_{12}$-$C_{14}$ alkyl polyethoxylate (3) sulfate ("AES")) | 0 | 0 | 17.2 | 16.7 | 6.6 | 8.4 | 11.1 |
| Alkyl sulphonate surfactant $C_{11.8}$ linear alkylbenzene sulfonc acid ("LAS")) | 17.8 | 0.6 | 0.6 | 0.6 | 6.6 | 4.9 | 2.2 |
| Nonionic surfactant ($C_{12}$-$C_{14}$ branched alcohol - 7 ethoxylate) | 0.4 | 17.6 | 0.4 | 0.4 | 0.2 | 0.2 | 0.2 |
| Nonionic surfactant ($C_{12}$ alkyl dimethyl amine oxide) | 0 | 0 | 0 | 0.5 | 0.5 | 0.5 | 0.5 |
| Surfactant System (total) | 18.2 | 18.2 | 18.2 | 18.2 | 14.0 | 13.9 | 14.0 |
| Major portion of surfactant system (as % of surfactant system) | 97.8% LAS | 96.8% nonionic | 94.6% AES | 91.7% AES | 47% AES | 60% AES | 79% AES |
| $C_{12}$-$C_{18}$ Fatty Acid | 1.0 | 1.0 | 1.0 | 1.0 | 0.7 | 0.7 | 0.7 |
| Na Cumene Sulfonate | 1.9 | 1.9 | 1.9 | 1.9 | 0.3 | 0.3 | 0.3 |
| Citric acid | 1.3 | 1.3 | 1.3 | 1.3 | 1.6 | 1.6 | 1.6 |
| Sodium tetraborate premix (15% active) | 1.6 | 1.6 | 1.6 | 1.6 | 1.4 | 1.4 | 1.4 |
| Enzymes (including protease and/or amylase) | 0.033 | 0.033 | 0.033 | 0.033 | 0.017 | 0.017 | 0.017 |
| Fluorescent Whitening Agent[1] | 0.08 | 0.08 | 0.08 | 0.08 | 0.05 | 0.05 | 0.05 |
| Diethylenetriamine pentaacetic acid | 0.2 | 0.2 | 0.2 | 0.2 | 0.35 | 0.35 | 0.35 |
| Cleaning polymers (ethoxylated polyamine[2], zwitterionic ethoxylated quaternized sulfated hexamethylene diamine[1] | 1.3 | 1.3 | 1.3 | 1.3 | 2.0 | 2.0 | 2.0 |
| Hydrogenated castor oil[3] | 0.15 | 0.15 | 0.15 | 0.15 | 0.12 | 0.12 | 0.12 |
| Encapsulates[4] | 0.40 | 0.40 | 0.40 | 0.40 | 0.20 | 0.20 | 0.20 |
| Organosiloxane polymer (anti-foam)[5] | 0.003 | 0.003 | 0.003 | 0.003 | 0.001 | 0.001 | 0.001 |
| Water, perfumes, dyes, buffers, solvents and other optional components | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 |

[1]Available from BASF (Ludwigshafen, Germany)

[2]600 g/mol molecular weight polyethylenimine core with 20 ethoxylate groups per —NH and available from BASF (Ludwigshafen, Germany)

[3]Available under the tradename ThixinR from Elementis Specialties, Highstown, NJ

[4]Aminoplast perfume accord encapsulates with poly(vinylformamide coating); available from Encapsys, Appleton, WI

[5]Available from Dow Corning, Midland, MI

Example 2—Deposition and Headspace Analysis

Fabrics (100% cotton terry towels) were treated, according to the Fabric Preparation method B1 above, with the formulations 1A, 1B, and 1C found in Table 1. The fabrics were then analyzed according to the Deposition and Headspace Analysis test methods given above, with the results shown in Table 2.

TABLE 2

| Trial | Formulation from Table 1 (major portion of surfactant system) | Deposition | Dry Fabric Headspace |
|---|---|---|---|
| 2A (comp.) | 1A (97.8% LAS) | 22% | REF |
| 2B (comp.) | 1B (96.8% nonionic) | 24% | 1.2 |
| 2C | 1C (94.6% AES) | 59% | 2.7 |

As shown in Table 2, the detergent composition having alkoxylated alkyl sulphate surfactant as the major portion of its surfactant system (Trial 2C) resulted in the highest percentage of deposition of the coated encapsulates compared to other samples that had LAS or nonionic surfactant as the major portion. Trial 2C also resulted in the greatest Dry Fabric Headspace measurement.

Example 3—Coated vs. Uncoated Encapsulates

A detergent composition according to Formulation 1D was prepared with coated encapsulates. A comparative composition having generally the same formulation was also prepared, where uncoated encapsulates were substituted for the coated encapsulates. The uncoated encapsulates are made from the same process as the coated encapsulates, and are removed from the process before the coating is applied. Fabrics were treated with these detergents and then analyzed according to the Deposition test method, with the results shown in Table 3.

TABLE 3

| Trial | Formulation 1D (surfactant system: 91.7% AES) | Deposition |
|---|---|---|
| 3A | With coated encapsulates | 58% |
| 3B (comp.) | With uncoated encapsulates | 27% |

As shown in Table 3, a formulation according to the present disclosure that includes coated encapsulates (Trial 3A) results in better deposition efficiency than a similar formulation that includes uncoated encapsulates (Trial 3B).

Example 4. Deposition and Headspace Analysis with Additional Formulations

Fabrics (100% cotton terry towels) were treated, according to the Fabric Preparation method B1 above, with the formulations 1A, 1B, and 1C found in Table 1. The fabrics were then analyzed according to the Headspace Analysis test method given above, with the results shown in Table 4.

TABLE 4

| Trial | Formulation from Table 1 (% AES of total) | Ratio of AES:LAS | Dry Fabric Headspace |
|---|---|---|---|
| 4A (comp.) | 1E | 1:1 | REF |
| 4B (comp.) | 1F | 1.5:1 | 1.1 |
| 4C | 1G | 5:1 | 1.7 |

As shown in Table 4, the detergent composition having alkoxylated alkyl sulphate surfactant as the major portion of its surfactant system (Trial 4C) resulted in the highest dry fabric headspace compared to other samples that had a lower percentage of anionic alkoxylated sulfate relative to the ratio of anionic sulphonate.

Example 5. Additional Formulations

TABLE 5

| Ingredient (wt %) | 2A | 2B | 2C | 2D | 2E | 2F | 2G |
|---|---|---|---|---|---|---|---|
| $C_{12}$-$C_{15}$ alkyl polyethoxylate (1.8) sulfate | 19.8 | 18.3 | 17.2 | 15.4 | 9.2 | 8.6 | 7.4 |
| $C_{11.8}$ linear alkylbenzene sulfonic acid | 0.4 | 1.8 | 3.4 | 5.1 | 0.9 | 1.8 | 2.2 |
| $C_{12}$-$C_{14}$ alcohol 9 ethoxylate | 0.4 | 0.4 | 0.4 | 0.4 | 0.4 | 0.4 | 0.4 |
| $C_{12}$-$C_{18}$ Fatty Acid | 1 | 1 | 1 | 1 | — | — | — |
| $C_{12}$ alkyl dimethyl amine oxide | — | — | — | — | 0.5 | 0.5 | — |
| Surfactant System (total) | 21.6 | 21.5 | 22 | 21.9 | 11 | 11.3 | 10.0 |
| Major portion of surfactant system (as % of surfactant system) | 91.7% AES | 85.1% AES | 78.2% AES | 70.3% AES | 83.6% AES | 76.1% AES | 74.0% AES |
| Na Cumene Sulfonate | 0.2 | 0.2 | 0.2 | 0.2 | — | — | — |
| Citric acid | 1.3 | 1.3 | 1.3 | 1.3 | 1.05 | 1.05 | 1.05 |
| Sodium tetraborate premix (27% active) | 1.6 | 1.6 | 1.6 | 1.6 | 1.23 | 1.23 | 1.23 |
| Enzymes (incl. protease and/or amylase) | 0.05 | 0.05 | 0.05 | 0.05 | 0.05 | 0.05 | 0.05 |
| Fluorescent Whitening Agent[1] | 0.08 | 0.08 | 0.08 | 0.08 | 0.050 | 0.050 | 0.050 |
| Diethylenetriamine pentaacetic acid | 0.2 | 0.2 | 0.2 | 0.2 | 0.3 | 0.3 | 0.3 |
| Cleaning polymers[1,2,6] | 1.5 | 1.5 | 3.0 | 0.8 | 0.8 | 0.8 | 0.8 |
| Hydrogenated castor oil[3] | 0.15 | 0.15 | 0.15 | 0.15 | 0.15 | 0.15 | 0.15 |
| Encapsulates[4] | 0.26 | 0.26 | 0.40 | 0.6 | 0.3 | 0.3 | 0.3 |
| Anti-foam agent[5] | 0.003 | 0.003 | 0.003 | 0.003 | 0.004 | 0.004 | 0.004 |
| Water, perfumes, dyes, buffers, solvents, chelant and other optional components | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 | to 100% pH 7.8-8.2 |

[1]Available from BASF (Ludwigshafen, Germany)

[2]600 g/mol molecular weight polyethylenimine core with 20 ethoxylate groups per —NH and available from BASF (Ludwigshafen, Germany)

[3]Available under the tradename ThixinR from Elementis Specialties, Highstown, NJ

[4]Aminoplast perfume accord encapsulates with poly(vinylformamide coating); available from Encapsys, Appleton, WI

[5]Available from Dow Corning, Midland, MI

[6]600 g/mol molecular weight polyethylenimine core with 24 ethoxylate groups per —NH and 16 propoxylate groups per —NH. Available from BASF (Ludwigshafen, Germany)

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid detergent composition comprising:

A) from about 15% to about 60%, by weight of the detergent composition, of a surfactant system, wherein the surfactant system comprises:

a) an anionic alkoxylated alkyl sulphate surfactant present at a level of about 90% to 100%, by weight of the surfactant system;

b) up to 5% by weight of the surfactant system of a linear alkyl benzene sulfonate;

c) up to 5% by weight of the surfactant system of a nonionic surfactant selected from the group consisting of an alkoxylated fatty alcohol, an amine oxide, or mixtures thereof;

B) from about 0,1% to about 5%, by weight of the composition, of encapsulates, wherein the encapsulates comprise a core and a wall at least partially surrounding the core, wherein the core comprises a benefit agent, and the wall comprises a coating on an outer surface of the wall; and C) an external structurant.

2. A detergent composition according to claim 1, wherein the composition comprises from about 15% to about 20%, by weight of the detergent composition, of a surfactant system.

3. A detergent composition according to claim 1, wherein the composition comprises up to about 95%, by weight of the surfactant system, of an anionic alkoxylated alkyl sulphate surfactant.

4. A detergent composition according to claim 1, wherein the anionic alkoxylated alkyl sulphate surfactant comprises an anionic ethoxylated alkyl sulphate surfactant.

5. A detergent composition according to claim 4, wherein the anionic ethoxylated alkyl sulphate surfactant has an average degree of ethoxylation of from about 1 to about 5.

6. A detergent composition according to claim 1, wherein the anionic alkoxylated alkyl sulphate surfactant comprises an alkoxylated C10-C16 sulphate surfactant.

7. A detergent composition according to claim 1, wherein the nonionic surfactant comprises a nonionic alkoxylated fatty alcohol surfactant.

8. A detergent composition according to claim 1, wherein the composition comprises from about 0.1% to about 1% of the encapsulates.

9. A detergent composition according to claim 1, wherein the benefit agent comprises perfume raw materials.

10. A detergent composition according to claim 1, wherein the coating comprises a cationic efficiency polymer.

11. A detergent composition according to claim 1, wherein the coating comprises a cationic efficiency polymer selected from polyvinyl amines, polyvinyl formamides, polyallyl amines, copolymers thereof, and mixtures thereof, preferably polyvinyl formamide.

12. A detergent composition according to claim 1, wherein the wall comprises a wall material selected from the group consisting of aminoplast copolymer, an acrylic, an acrylate, and mixtures thereof.

13. A detergent composition according to claim 12, wherein the wall material comprises an aminoplast copolymer, preferably an aminoplast copolymer selected from melamine-formaldehyde, urea-formaldehyde, cross-linked melamine formaldehyde, or mixtures thereof.

14. A detergent composition according to claim 1, wherein the composition further comprises a fatty acid or salt thereof.

15. A detergent composition according to claim 1, wherein the composition further comprises an adjunct selected from the group consisting of an enzyme, a brightener, a cleaning polymer, an amine, a hueing dye, or combinations thereof.

16. A method of treating a fabric, said method comprising the step of contacting a fabric with a detergent composition according to claim 1.

17. A detergent composition according to claim 1, wherein the coating comprises a cationic efficiency polymer selected from the group consisting of polysaccharides, cationically modified starch, cationically modified guar, polysiloxanes, poly diallyl dimethyl ammonium halides, copolymers of poly diallyl dimethyl ammonium chloride and vinyl pyrrolidone, acrylamides, imidazoles, imidazolinium halides, imidazolium halides, polyvinyl amines, polyvinyl formamides, pollyallyl amines, copolymers thereof, and mixtures thereof.

* * * * *